US009149169B2

(12) United States Patent
Patel et al.

(10) Patent No.: US 9,149,169 B2
(45) Date of Patent: Oct. 6, 2015

(54) DUAL SUCTION VACUUM APPARATUSES AND METHODS FOR USE

(76) Inventors: Pravinchandra Patel, Lumberton, NC (US); Nutan Patel, Lumberton, NC (US)

( * ) Notice: Subject to any disclaimer, the term of this patent is extended or adjusted under 35 U.S.C. 154(b) by 742 days.

(21) Appl. No.: 13/404,845

(22) Filed: Feb. 24, 2012

(65) Prior Publication Data

US 2013/0220378 A1 Aug. 29, 2013

(51) Int. Cl.

| | |
|---|---|
| ***B08B 3/00*** | (2006.01) |
| ***A47L 9/02*** | (2006.01) |
| ***A47L 9/10*** | (2006.01) |

(52) U.S. Cl.
CPC .... *A47L 9/02* (2013.01); *A47L 9/10* (2013.01)

(58) Field of Classification Search
None
See application file for complete search history.

(56) References Cited

U.S. PATENT DOCUMENTS

| | | | |
|---|---|---|---|
| 1,061,422 | A | 5/1913 | Sutton |
| 1,782,882 | A | 11/1930 | Rippey |
| 2,528,278 | A | 10/1950 | Kendrick |
| 2,555,979 | A | 6/1951 | Lofgren |
| 3,942,219 | A | 3/1976 | Johnson |
| 4,023,234 | A | 5/1977 | Martinec et al. |
| 4,219,902 | A | 9/1980 | DeMaagd |
| 4,395,794 | A | 8/1983 | Duncan |
| 4,499,628 | A | 2/1985 | Platt |
| 6,039,817 | A | 3/2000 | Payne |
| 7,134,164 | B2 | 11/2006 | Alton |

*Primary Examiner* — Eric Golightly
(74) *Attorney, Agent, or Firm* — Jenkins, Wilson, Taylor & Hunt, P.A.

(57) ABSTRACT

Apparatuses and methods for vacuuming floors and other surfaces can include a vacuum cleaner head having a first chamber in communication with a first inlet positioned on a bottom surface of the vacuum cleaner head and a first outlet connected to a vacuum line, a second chamber in communication with a second inlet positioned on at least one side of the vacuum cleaner head and a second outlet connected to the vacuum line, and a divider separating the first chamber from the second chamber.

14 Claims, 6 Drawing Sheets

DUAL SUCTION VACUUM APPARATUSES AND METHODS FOR USE

TECHNICAL FIELD

The subject matter disclosed herein relates generally to vacuum cleaners. More particularly, the subject matter disclosed herein relates to designs for a cleaning head of a vacuum cleaner and methods for the use thereof.

BACKGROUND

Vacuum cleaners commonly employ a downward-facing nozzle to apply suction to a carpet or other surface being cleaned. A long-standing difficulty with such an arrangement, however, is the inability to clean effectively in areas very close to a wall or other obstruction. For example, the edge of a carpeted area where it meets the wall often forms a crevice which tends to collect dirt and debris that conventional nozzle assemblies have difficulty removing.

Vacuum cleaner designers have attempted to deal with this problem by positioning the ends of the intake opening as close as possible to the lateral edges of the nozzle assembly. Even when the nozzle assembly is made as thin as possible, however, the end wall of the opening and the end support for the roller brush always create a gap that prevents the cleaning action from reaching into the crevice. In some instances, designs have small channels that extend laterally from the main airflow opening and under the roller brush end supports in an effort to generate some suction along the edges of the nozzle assembly, but these solutions often must be quite limited in size or else they will compromise the ability of the assembly to generate an upwards suction force with sufficient airflow when moving over the floor in areas away from the wall. Alternatively, many vacuum cleaners are provided with a separate "crack tool" or "crevice tool", which can be a flat, narrow nozzle that is mounted on the end of a suction hose. Although these tools usually work adequately, they add an additional step to the edge-cleaning process.

Accordingly, there exists a need for a vacuum cleaner assembly that provides an effective cleaning action along at least one lateral edge thereof so as to effectively remove dirt and debris along the junctures between the floor and walls or other obstructions. Furthermore, there exists a need for such an assembly to provide effective edge-cleaning without compromising the ability of the assembly to provide a vertical suction against floor surfaces when cleaning in areas away from the wall. In addition, there exists a need for such an assembly that is structurally simple, economical to manufacture, and durable in use.

SUMMARY

In accordance with this disclosure, devices and methods for vacuuming floors and other surfaces are provided. In one aspect, a vacuum cleaner head is provided. The vacuum cleaner head can comprise a first chamber in communication with a first inlet positioned on a bottom surface of the vacuum cleaner head and a first outlet connected to a vacuum line, a second chamber in communication with a second inlet positioned on at least one side of the vacuum cleaner head and a second outlet connected to the vacuum line, and a divider separating the first chamber from the second chamber.

In another aspect, a vacuum cleaner is provided. The vacuum cleaner can for example comprise a motor, a vacuum line connected to the motor, and a vacuum cleaner head connected to the vacuum line, and a receptacle in communication with the vacuum line and configured to receive dirt, dust, and debris. The vacuum cleaner head can comprise a first chamber in communication with a first inlet positioned on a bottom surface of the vacuum cleaner head and a first outlet connected to the vacuum line, a second chamber in communication with a second inlet positioned on at least one side of the vacuum cleaner head and a second outlet connected to the vacuum line, and a divider separating the first chamber from the second chamber.

In yet another aspect, a method for vacuuming a surface is provided. The method can for example comprise providing a vacuum cleaner head comprising a first chamber connected to a vacuum line through a first outlet and a second chamber connected to the vacuum line through a second outlet, drawing air and entrained dirt, dust, and debris into the first chamber through a first inlet positioned on a bottom surface of the vacuum cleaner head and to the vacuum line through the first outlet, and drawing air and entrained dirt, dust, and debris into the second chamber through a second inlet positioned on at least one side of the vacuum cleaner head and a second outlet connected to the vacuum line and to the vacuum line through the second outlet.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1:
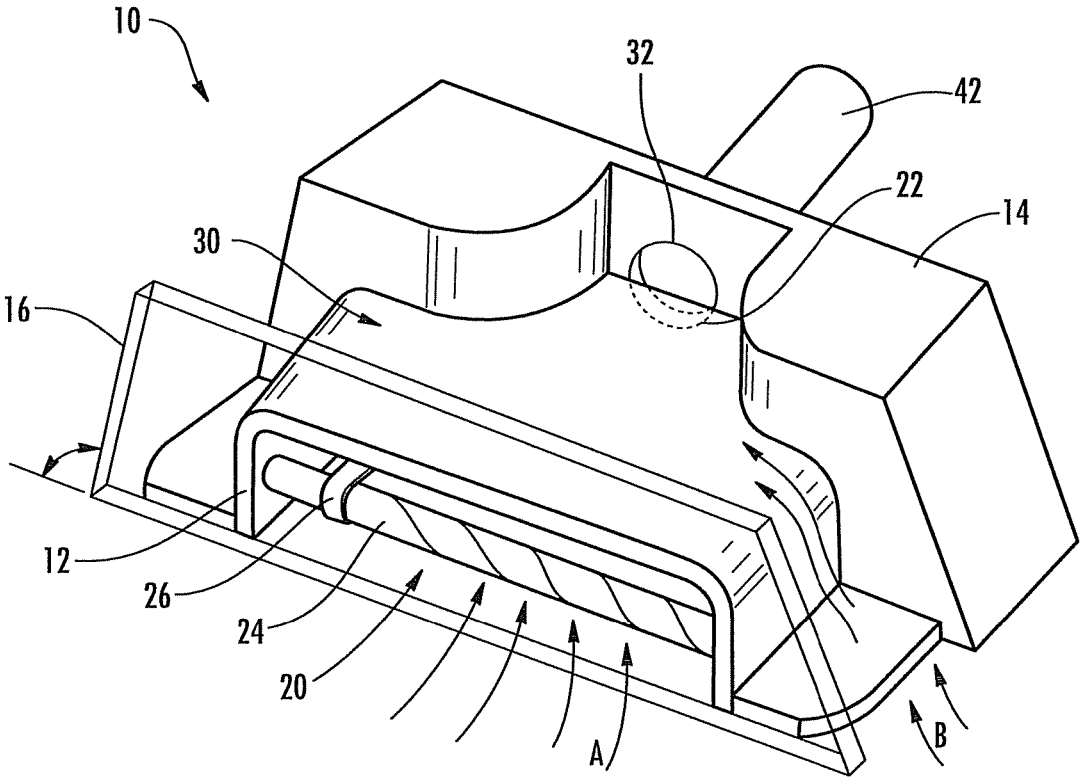
FIG. 1 is a perspective view of a vacuum cleaner head according to an embodiment of the presently disclosed subject matter.

The present subject matter provides apparatuses and methods for vacuuming floors with the ability to vacuum underneath protruding edges of furniture and along walls and other vertical surfaces. In one aspect, the present subject matter provides a vacuum cleaner head having two separate chambers for air (and dirt, dust, and debris) intake. For example, referring to FIG. 1, a vacuum cleaner head, generally designated 10, can comprise a first chamber 20 in communication with a first inlet A provided through a bottom surface of vacuum cleaner head 10. Specifically, first chamber 20 can be generally defined by a divider 12 positioned within vacuum cleaner head 10, a rear wall 14, and a front plate 16. In this configuration, first chamber 20 can be configured to receive air, along with any entrained dirt, dust, and debris, through downward-facing first inlet A in vacuum cleaner head 10 much like the air intake chamber of a conventional vacuum cleaner.

Further like a conventional vacuum cleaner, vacuum cleaner head 10 can also comprise a roller belt assembly positioned within first chamber 20 to assist the pickup and collection of dirt, dust, and debris into first chamber 20. Specifically as shown in FIG. 1, the roller belt assembly can comprise a roller 24 rotationally movable within first chamber 20 and a drive belt 26 operably connected to roller 24 and movable to cause rotation of roller 24 within first chamber 20. In particular, divider 12 can be shaped such that it forms both an upper boundary and lateral boundaries of first chamber 20, with two side portions of divider 12 being substantially vertical such that roller 24 can be rotatably mounted thereto. The roller belt assembly can be operated to agitate the surface over which vacuum cleaner head 10 passes to draw dirt, dust, and debris up from the surface as understood by those having skill in the art.

In contrast to conventional vacuum cleaner designs, however, vacuum cleaner head 10 can further comprise a second chamber 30 in communication with a second inlet B through at least one side of vacuum cleaner head 10. Second chamber 30 can be separated from first chamber 20 by divider 12 and can be bounded by rear wall 14, front plate 16, and a top cover 18 (not shown in FIG. 1). Thus, rather than being accessible only from a bottom side like first chamber 20, second chamber 30 can be accessed through one or both lateral sides of vacuum cleaner head 10. For example, in the configuration shown in FIG. 1, one or more second inlet B can be provided on each of two opposing sides of vacuum cleaner head 10. In this way, second chamber 30 can provide a flow path into vacuum cleaner head 10 for the removal of dirt, dust, and debris in addition to a typical downward-facing inlet (i.e., first inlet A).

Both first chamber 20 and second chamber 30 can be connected to a common vacuum line 42 through which air and any entrained dirt or debris can be drawn. Specifically, in the configuration shown in FIG. 1, first chamber 20 can be in communication with a first outlet 22 connected to vacuum line 42, and second chamber 30 can be in communication with a second outlet 32 connected to vacuum line 42. In particular, as shown in FIG. 1, first outlet 22 and second outlet 32 can be formed from a single opening in back wall 14 of vacuum cleaner head 10 that is traversed by divider 12. In this configuration, divider 12 can maintain substantially separate flow paths into and through first chamber 20 and second chamber 30, but the common connection to vacuum line 42 can reduce the complexity of the system in spite of its dual-path configuration.

Figure 2:
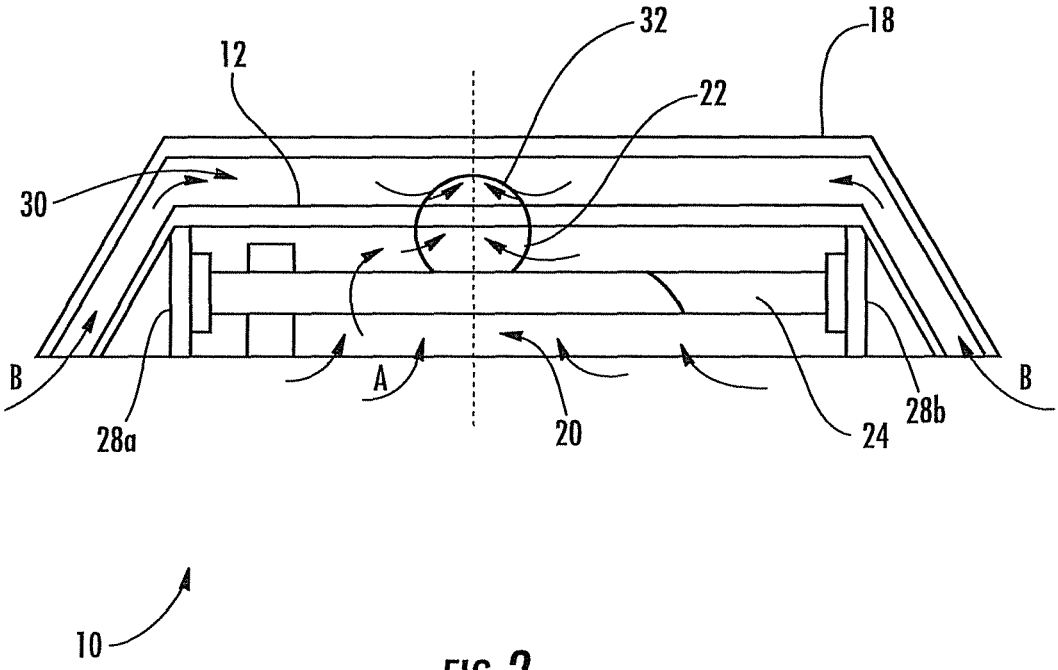
FIG. 2 is a front cutaway view of the vacuum cleaner head according to an embodiment of the presently disclosed subject matter.

FIG. 2 shows a slightly modified version of this configuration of vacuum cleaner head 10. Whereas divider 12 shown in FIG. 1 can include substantially vertical side portions between which roller 24 can be mounted, the configuration for vacuum cleaner head 10 shown in FIG. 2 can comprise additional interior side walls 28*a* and 28*b* positioned within first chamber 20 for this purpose. In this configuration, roller 24 can be rotatably mounted between interior side walls 28*a* and 28*b*, and divider 12 can thereby be shaped in any of a variety of configurations. As shown in FIG. 2, for example, divider 12 can have a substantially sloped profile, thereby allowing air, dirt, dust, and debris to more smoothly enter second chamber 30 through second inlet B.

Figure 3:
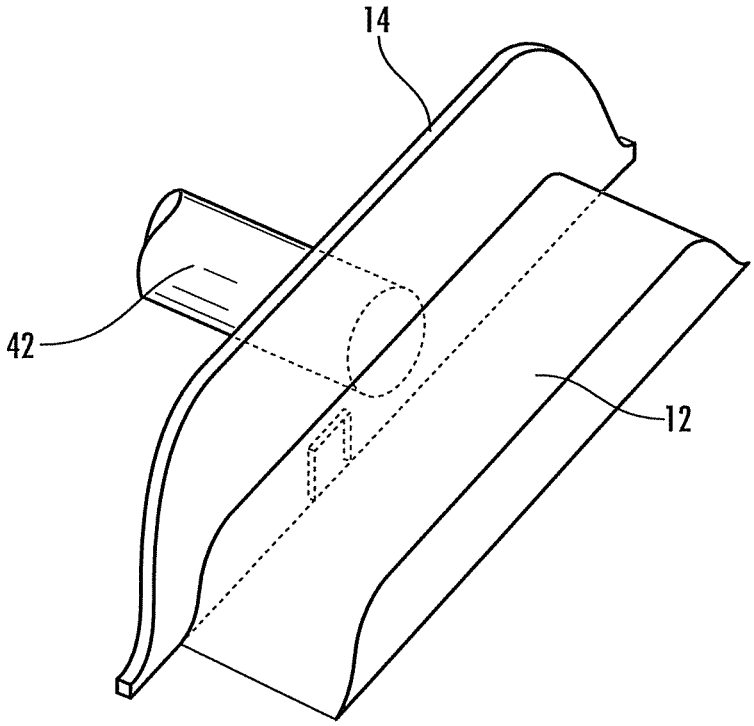
FIG. 3 is a perspective view of an alternative configuration for a vacuum cleaner head according to an embodiment of the presently disclosed subject matter.

FIG. 3 shows a further alternative configuration of vacuum cleaner head 10. In this configuration, divider 12 can have a more curved profile, which can further encourage airflow through second inlet B to smoothly pass into second chamber 30 and toward second outlet 32 connected to vacuum line 42. In this way, the shape of divider 12 can help to reduce turbulence of the air flow entering second chamber 30 as well as eliminate corners into which dirt, dust, and debris can settle. Although not shown in FIG. 3, those having ordinary skill in the art will appreciate that the structures of first and second chambers 20 and 30 can further be contoured to improve the flow of air and entrained dirt, dust, and debris to vacuum line 42. For example, as shown in FIG. 1, rear wall 14 can be contoured to funnel air flow through second chamber 30 towards second outlet 32. Likewise, additional flow routing structures can be incorporated into vacuum cleaner head 10 to streamline air flow to vacuum line 42 and reduce or eliminate corners and/or recesses that can allow for the settling and collection of dirt, dust, and debris within vacuum cleaner head 10.

Operation of vacuum cleaner head 10 can further be determined at least in part based on the positioning of second inlet B. For instance, as shown in FIG. 2, second inlet B can be formed along one or more lateral edges of vacuum cleaner head 10 on a downward-facing surface of vacuum cleaner head 10 (i.e., second inlet B facing downward towards the surface to be cleaned). In this configuration, air and entrained dirt, dust, and debris can enter second inlet B in a similar manner to conventional vacuum cleaner inlets, albeit in a localized region of vacuum cleaner head 10 to more particularly target edges, crevices, or other hard-to-reach areas.

Alternatively, second inlet B can be formed on a bottom edge of a side surface of vacuum cleaner head 10 (i.e., second inlet B facing sideways). In this configuration, air and entrained dirt, dust, and debris can enter second inlet B at a different angle than conventional vacuum cleaners. This different flow entry path can help to collect dirt, dust, and debris in places that typical downward-facing vacuum cleaner heads struggle (e.g., at edges and under furniture).

Figure 4A:
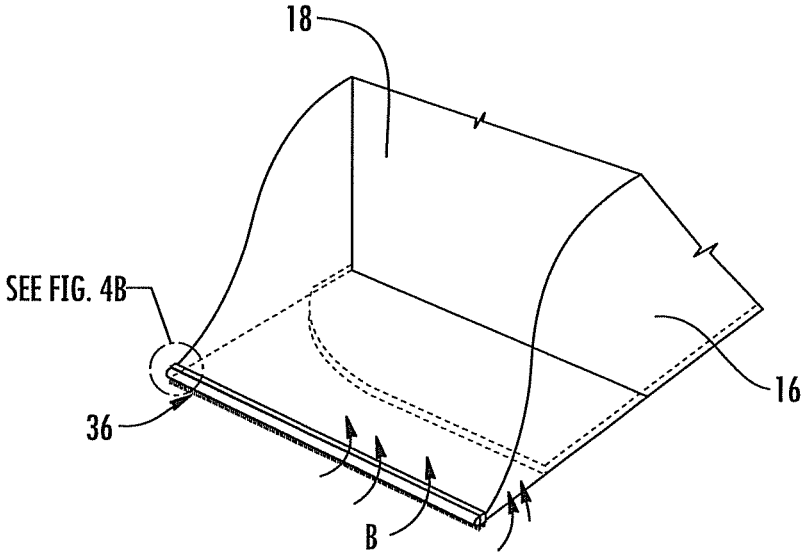
FIG. 4A is a perspective view of a side inlet into one chamber of a vacuum cleaner head according to an embodiment of the presently disclosed subject matter.
Figure 4B:
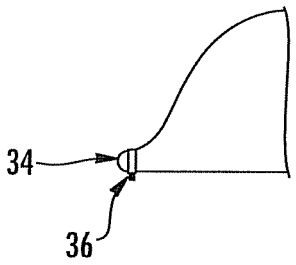
FIG. 4B is a side detail view of a side inlet into one chamber of a vacuum cleaner head according to an embodiment of the presently disclosed subject matter.

In addition, as shown in FIGS. 4A and 4B, vacuum cleaner head 10 can comprise further features to assist collection of dirt, dust, and debris into second inlet B. For example, as shown in FIG. 4A, a plurality of short (e.g., about 3/16 inch) bristles can be provided along an edge of second inlet B to help sweep up dirt, dust, and debris along the edges of vacuum cleaner head 10. In addition, as shown in FIG. 4B, an edge guard, generally designated 34, can at least partially surround second inlet B to cushion any contact of vacuum cleaner head 10 with furniture or walls to prevent damage to these objects.

Regardless of the differences between the configurations for vacuum cleaner head 10, such as those shown in FIGS. 1, 2, and 3, however, the same general principle applies that air, dirt, and debris can be passed through vacuum cleaner head 10 to vacuum line 42 either through first inlet A, into first chamber 20, and out through first outlet 22, or though second inlet B, into second chamber 30, and out through second outlet 32.

Figure 5:
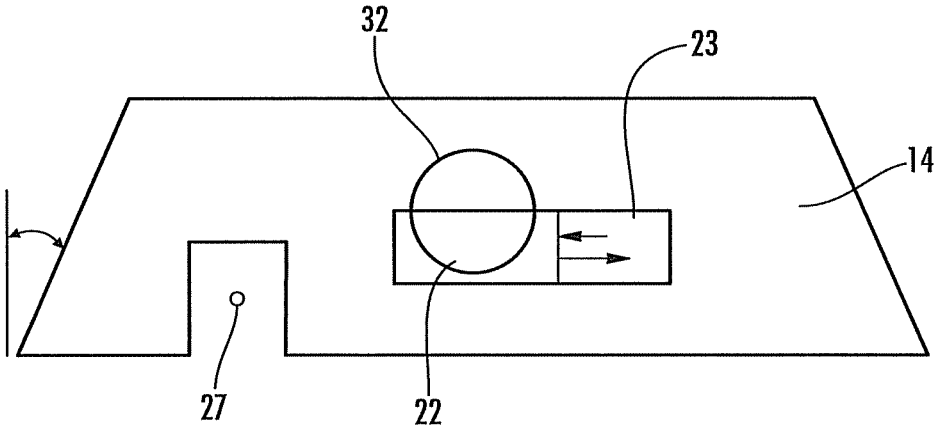
FIG. 5 is an elevation view of a rear wall of a vacuum cleaner head according to an embodiment of the presently disclosed subject matter.

In addition, to further modify the operation of vacuum cleaner head 10, a shutter assembly can be operable to close off one of the chambers from the vacuum line, thereby increasing air flow through the other, unobstructed chamber. In other words, by blocking air flow through one chamber, additional suction can be diverted to the unobstructed chamber. For example, as shown in FIG. 5, a shutter assembly, generally designated 23, can be provided in the form of a movable door that is slidably mounted to rear wall 14 and is movable into or out of registry with first outlet 22. Of course, those having ordinary skill in the art will recognize that other mechanisms can function in a similar manner to selectively open and close first outlet 22.

Regardless of the specific configuration, shutter assembly 23 can be movable into a position that substantially obstructs first outlet 22 such that substantially the entirety of the suction provided by vacuum line 42 is diverted to second outlet 32. In this way, suspending air flow through first chamber 20 can thereby increase air flow through second chamber 30 to allow vacuum cleaner head 10 to more effectively draw dirt, dust, and debris from edges, crevices, or other hard-to-reach areas into second inlet B. As a result, shutter assembly 23 can be selectively activated when concentrated edge cleaning is desired. Alternatively or in addition, although shutter assembly 23 is disclosed herein as being movable to selectively obstruct first outlet 22, a similar structure can be movable with respect to second outlet 32 to selectively obstruct second outlet 32. In this way, suction can be provided only through first chamber 20, thus enabling vacuum cleaner head 10 to be operated in a similar manner to conventional vacuum cleaners.

Figure 6:
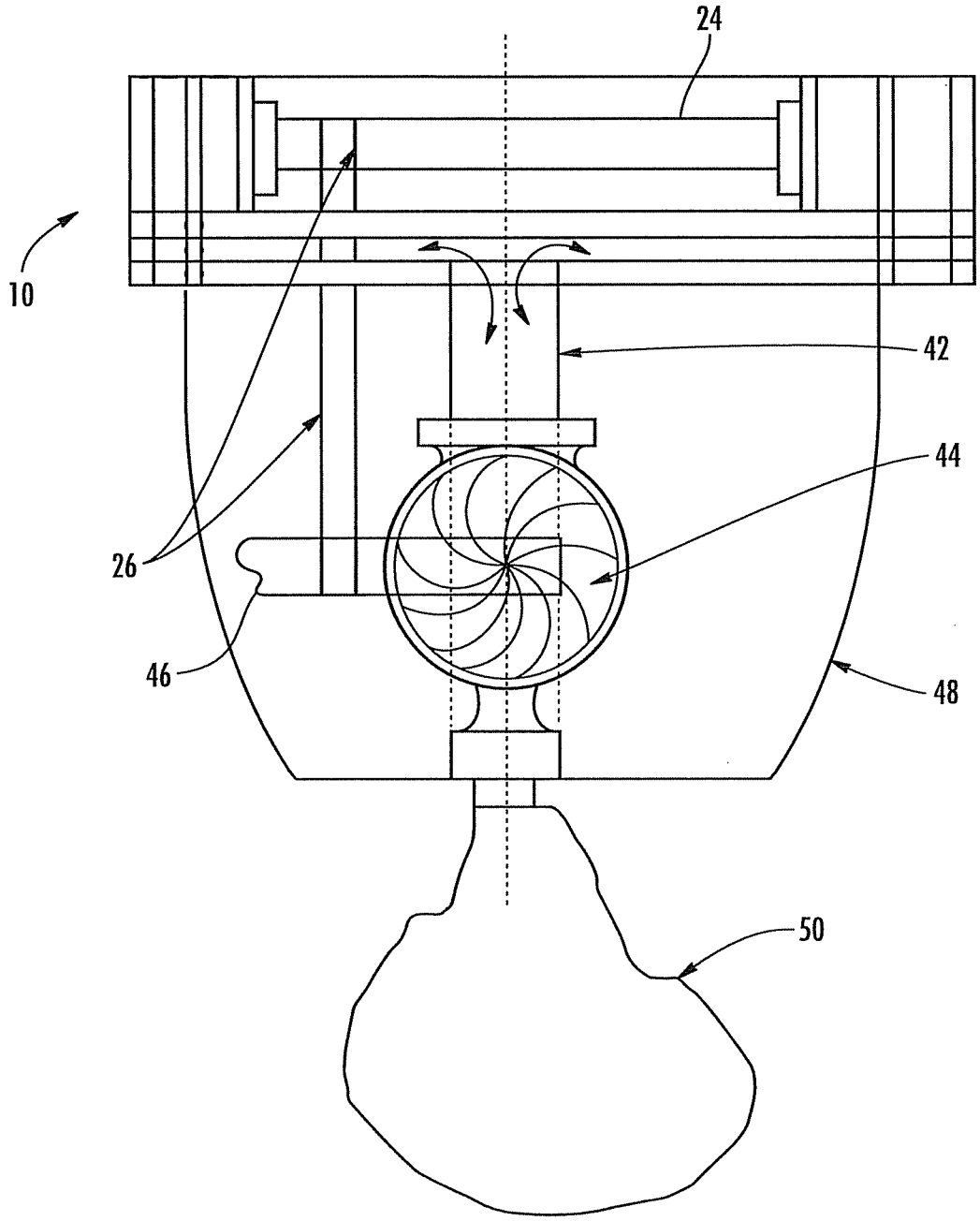
FIG. 6 is a top cutaway view of a vacuum cleaner comprising a vacuum cleaner head according to an embodiment of the presently disclosed subject matter.

Regardless of the specific configuration of vacuum cleaner head 10, the principles discussed herein can be integrated into a vacuum cleaner, generally designated 40 and shown in FIG. 6. As illustrated in FIG. 6, vacuum cleaner 40 can comprise vacuum line 42 to which first and second chambers 20 and 30 of vacuum cleaner head 10 can be connected through first and second outlets 22 and 32, respectively. Vacuum line 42 can be operably connected to a motor 44 that generates a partial vacuum, thereby generating the suction used to draw air, dirt, and debris into vacuum line 42. A receptacle 50 can be positioned in communication with vacuum line 42 for receiving any dirt, debris, or other matter collected through vacuum cleaner head 10. Vacuum cleaner 40 can further comprise a drive shaft 46 coupled to motor 44 and connected to drive belt 26. In this way, operation of motor 44 can cause rotation of drive shaft 46, which can in turn cause movement of drive belt 26 to drive roller 24 as understood by those having skill in the art. To connect drive belt 26 between drive shaft 46 and roller 24, a cutout 27 can be formed in rear wall 14 (See, e.g., FIG. 5) to allow drive belt 26 to pass therethrough. Finally, vacuum cleaner 40 can comprise a protective casing 48 that surrounds one or more of the components of vacuum cleaner 40 to conceal the moving parts of vacuum cleaner 40 and protect the components from damage.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A vacuum cleaner head comprising:

a first chamber in communication with a first inlet positioned on a bottom surface of the vacuum cleaner head and a first outlet connected to a vacuum line;

a second chamber in communication with a second inlet comprising one opening on each of two opposing sides of the vacuum cleaner head and a second outlet connected between both of the openings on each of the two opposing sides of the vacuum cleaner head and the vacuum line; and a divider separating the first chamber from the second chamber.

2. The vacuum cleaner head of claim 1, wherein the second inlet is positioned at a lateral edge of the bottom surface of the vacuum cleaner head.

3. The vacuum cleaner head of claim 1, wherein the second inlet is positioned at a bottom edge of a side surface of the vacuum cleaner head.

4. The vacuum cleaner head of claim 1, comprising a shutter assembly movable with respect to the first outlet to substantially obstruct communication between the first outlet and the vacuum line.

5. The vacuum cleaner head of claim 4, wherein the shutter assembly comprises a movable door that is slidably movable into or out of registry with the first outlet.

6. The vacuum cleaner head of claim 1, comprising a roller belt assembly positioned within the first chamber.

7. The vacuum cleaner head of claim 6, wherein the roller belt assembly comprises a roller rotationally movable within the first chamber and a drive belt operably connected to the roller and movable to cause rotation of the roller within the first chamber.

8. A vacuum cleaner comprising:

a motor;

a vacuum line connected to the motor;

a vacuum cleaner head comprising:

a first chamber in communication with a first inlet positioned on a bottom surface of the vacuum cleaner head and a first outlet connected to the vacuum line;

a second chamber in communication with a second inlet comprising one opening on each of two opposing sides of the vacuum cleaner head and a second outlet connected between both of the openings on each of the two opposing sides of the vacuum cleaner head and the vacuum line; and a divider separating the first chamber from the second chamber; and a receptacle in communication with the vacuum line and configured to receive dirt, dust, and debris.

9. The vacuum cleaner head of claim 8, wherein the second inlet is positioned at a lateral edge of the bottom surface of the vacuum cleaner head.

10. The vacuum cleaner head of claim 8, wherein the second inlet is positioned at a bottom edge of a side surface of the vacuum cleaner head.

11. The vacuum cleaner head of claim 8, comprising a shutter assembly movable with respect to the first outlet to substantially obstruct communication between the first outlet and the vacuum line.

12. The vacuum cleaner head of claim 11, wherein the shutter assembly comprises a movable door that is slidably movable into or out of registry with the first outlet.

13. The vacuum cleaner of claim 8, comprising a roller belt assembly positioned within the first chamber and operably connected to the motor.

14. The vacuum cleaner of claim 13, wherein the roller belt assembly comprises a roller rotationally movable within the first chamber and a drive belt operably connected to the roller and to the motor and movable to cause rotation of the roller within the first chamber.

* * * * *